United States Patent [19]

Butcher et al.

[11] Patent Number: 4,954,138

[45] Date of Patent: Sep. 4, 1990

[54] STONE TO FINISH STONE WASHED JEANS

[75] Inventors: Kenneth R. Butcher, Hendersonville, N.C.; Carmine M. Doddato, Cuyahoga Falls; Donna M. Stough, Kent, both of Ohio

[73] Assignee: Norton Company, Worcester, Mass.

[21] Appl. No.: 268,097

[22] Filed: Nov. 7, 1988

[51] Int. Cl.[5] ..... B24D 3/00

[52] U.S. Cl. ..... 51/293; 51/307; 51/308; 51/309; 106/214; 106/DIG. 2; 106/698; 106/675

[58] Field of Search ..... 51/293, 303, 307, 308, 51/309; 106/84, 214, DIG. 2

[56] References Cited

U.S. PATENT DOCUMENTS

| | | | |
|---|---|---|---|
| 2,526,073 | 10/1950 | Gardner | 106/40 |
| 2,699,409 | 1/1955 | Hashimoto | 117/100 |
| 2,728,733 | 12/1955 | Hashimoto | 252/449 |
| 3,203,813 | 8/1965 | Gajardo | 106/40 |
| 3,913,281 | 10/1975 | Jones | 51/307 |
| 3,930,872 | 1/1976 | Toeniskoetter et al. | 106/85 |
| 4,021,208 | 5/1977 | Oberbichler | 51/307 |
| 4,128,972 | 12/1978 | Charvat | 51/298 |
| 4,381,188 | 4/1983 | Waizer et al. | 51/307 |
| 4,381,925 | 5/1983 | Celleselli | 51/307 |
| 4,415,364 | 11/1983 | Naito et al. | 106/74 |
| 4,416,694 | 11/1983 | Stevenson et al. | 106/84 |
| 4,446,040 | 5/1984 | Samanta | 252/62 |
| 4,500,325 | 2/1985 | Huber et al. | 51/307 |
| 4,504,283 | 3/1985 | Charvat | 51/298 |
| 4,588,420 | 5/1986 | Charvat | 51/298 |

FOREIGN PATENT DOCUMENTS 2118463 11/1983 United Kingdom .

*Primary Examiner*—Paul Lieberman
*Assistant Examiner*—Willie Thompson
*Attorney, Agent, or Firm*—David Bennett

[57] ABSTRACT

A product and method for conditioning fabrics, especially denim, is disclosed. The product is an artificial stone made up of an inorganic filler, inorganic abrasive particles and an inorganic bond for the filler and abrasive. The method is the use of the stone to condition fabrics.

6 Claims, No Drawings

STONE TO FINISH STONE WASHED JEANS

TECHNICAL FIELD

This invention relates to an artificial member or stone and its use in fabric finishing operations, i.e. to produce "stone washed" denim clothing, such as jeans, or to generally soften a fabric.

BACKGROUND AND INFORMATION DISCLOSURE STATEMENT

The following publications are representative of the most relevant prior art known to applicants at the time of filing of the application.

| | U.S. PATS. | |
|---|---|---|
| 2,526,073 | October 17, 1950 | Gardner |
| 2,699,409 | January 11, 1955 | Hashimoto |
| 2,728,733 | December 7, 1955 | Hashimoto |
| 3,203,813 | August 31, 1965 | Gajardo et al. |
| 4,446,040 | May 1, 1984 | Samanta |
| | Other Publication | |
| GB 2,118,463A | November 2, 1983 | Conti |

Denim clothing, particularly jeans, is sometimes artificially aged during its manufacture to provide it with appearance, softness, and other such characteristics as may be dictated by prevailing fashion and marketing requirements. One currently popular aging process entails "stone washing" the denim as a part of the fabric finishing operation. This is conventionally performed by subjecting the denim fabric to a laundering and tumbling procedure in the presence of pumice stones to produce an abrasive action that serves to soften the fabric and also modify its appearance. Pumice has been used in this process since it is an inexpensive naturally occurring mildly abrasive material. However, pumice suffers from two major defects, i.e. (i) it is so friable that it may easily be crushed by hand and (ii) it is a natural product having such inconsistencies in strength, size, and shape that they effect its reproducibility in use. The friability problem means that, during stone washing, the pumice stones are rapidly abraded to such a small size that they become ineffective for further fabric finishing operations. In addition, the abraded pumice particles are often carried away with the wash water and, as a result, both clog drains and sewage systems, and get deposited into the pockets of the denim articles being treated, which deposits are removed before sale of the articles. The non-uniformity of the pumice serves to complicate the finishing process and make finishing to a constant appearance well nigh impossible.

British Application 2,118,463A discloses an abrasive rolling member for use in a denim finishing operation. The member is described as being "made of artificial pumice having vitrified inclusions formed therein and has either a cylindrical shape . . . or has a spherical shape." The document contains no additional explanation as to what is meant by the phrase "artificial pumice." But since pumice is a porous volcanic glass, "artificial pumice" would appear to mean a man-made version of pumice in which various molten silicates are cooled under pressure and then fused in a crucible.

U.S. Pat. Nos. 2,526,073, 2,699,409, and 2,728,733 show building materials formed from mixtures of expanded perlite and clay which are fired at a high temperature. There are no disclosures of using these materials in fabric finishing operations and the properties required for a building material are decidedly different than those for an abrasive rolling member used for stone washing.

U.S. Pat. Nos. 3,203,813 and 4,446,040 show insulating materials formed of perlite and clay which are dried at a comparatively low temperature and which may subsequently be exposed to a high temperature. There are no disclosures of using these materials in fabric finishing operations and the properties required for an insulating material are decidedly different than those for an abrasive rolling member used for stone washing.

Thus the prior art teaches the use of pumice, either natural or man-made, as the abrasive rolling member or stone in fabric finishing operations. While man-made pumice overcomes some of the non-uniformity and friability problems of the natural material, there is still need for considerable improvement. Accordingly, there is a need for an improved abrasive stone for use in fabric finishing operations. It is an object of the present invention to produce such an improved stone. It is a further object of this invention to utilize the improved member in fabric finishing operations.

SUMMARY OF THE INVENTION

The present invention provides a manufactured abrasive, water-insoluble fabric finishing stone which is prepared from a combination of particulates comprised of at least one filler material, at least one bonding agent, and optionally at least one abrasive material, and wherein at least the filler material or the bonding agent is inorganic, the finishing stone has a packing density of less than about 50 pounds per cubic foot, and loses less than about 15 percent of its weight in an abrasion test wherein about 2.5 pounds of the stones are placed in a 8.5 inch diameter by 7.25 inch long cylinder having a ribbed rubber lining and the cylinder is tumbled at 60 rpm for 1 hour.

DESCRIPTION OF THE PREFERRED EMBODIMENTS

The present invention produces an artificial fabric finishing stone which may be directly substituted for the pumice which is currently used in conventional fabric finishing operations. The stone is especially adapted for use in stone washing processes for softening and modifying the appearance of denim.

The fabric finishing stones of the present invention are prepared by combining at least one filler material, at least one bonding agent, and optionally at least one abrasive material, wherein at least the filler material or the bonding agent component is an inorganic material. If the filler material is inorganic, then it should be one which has a low density. If the filler material is organic then it should be one which will burn out during a subsequent calcination. In either case, the filler material can be essentially any material which is conventionally used as a filler in the production of insulation, paints, plastics, abrasives, oil-absorbers, and the like. Generally the density of the materials, if they are inorganic, will be as low as possible to easily produce finishing stones having the required packing densities below about 50 pounds per cubic foot. To obtain this low a density in a finishing stone, the inorganic filler material should have a density below about 20, preferably below about 15, and most preferably about 12 or less pounds per cubic foot. If the initial density of the inorganic filler is too high, then an organic filler material (which will burn out during a subsequent calcination and thereby lower the density of the finishing stone) may be added to compensate. In addition, the filler materials need be ones which are stable under the conditions used to form the stone and ones which do not densify during the formation of the stone. Also, they must be unaffected by conditions and chemicals used in conventional stone washing processes. Examples of suitable such inorganic fillers include perlite, vermiculite, hollow glass spheres, expanded clay, cellular diatomite, and the like. Examples of suitable organic fillers include walnut shells, saw dust, polypropylene beads, coconut shells, corncobs, and the like. Preferably the filler is inorganic, and most preferably the inorganic filler is perlite or vermiculite due to their low inherent densities and also their ready availability at low cost.

The bonding agents utilized in the invention serve to hold the filler particles together at least during the formation of the stones. As such, they function as "plasticizers" and may be either inorganic or organic compounds. Examples of bonding agents suitable for use herein include clays, silicates, cements, starches, cellulose ethers, polyvinyl alcohol, and microcrystalline cellulose. Preferably, the bonding agent is a silicate, i.e. an alkali metal, alkaline earth metal or ammonium silicate, preferably sodium or potassium silicate, since silicates form glass structures, during a subsequent calcination, which glass has been found to produce a better anchor for an inorganic filler in the finishing stones. Also preferable as the bonding agent are clay or a mixture of clay and a silicate. Most preferably a mixture of clay and a silicate is used as the bonding agent.

The abrasive material of the present invention may be any conventional abrasive matter which will retain its abrasive character during the conditions of stone formation and subsequent use. Examples of suitable abrasive materials include: sand, silicon carbide, alumina, silicon nitride, clay, and the like. Preferably, the abrasive material is clay or sand due to their ready availability at low cost.

It should be noted that clay may be utilized as both the bonding agent and the abrasive material in a finishing stone. In either case the clay will generally be a ball clay. The clay may particularly be a fire clay such as Kentucky or Tennessee kaolin or any similar material.

The sizes of the particles used for the filler materials and the bonding agents has not been found critical to the present invention. As such, they may have almost any particle size without adversely affecting the performance of the finishing stones produced. Generally, the filler material to produce the low density finishing stones will be used in the form of relatively large particles, i.e. greater than about 600 microns and up to about $\frac{1}{4}$ inch in diameter. The bonding agents are generally of smaller particle sizes than the filler materials to allow them to fill the interstices between the filler material particles. As such, they will usually be smaller than about 1000 microns and even as small as 40 microns. The abrasive materials, on the other hand, should not be too fine or else they will not be able to provide sufficient abrasiveness to the following stones. Accordingly, the abrasive materials should generally be coarser than about 100 microns, preferably coarser than 125 microns, and may even be as large as about 1000 microns though no benefit has been found from so doing.

To prepare the finishing stones of the present invention, the filler materials, bonding agents, and abrasive materials (if used) are intimately mixed. Generally, the filler material is present as about 15 to about 80 percent of the mixture, while the bonding agent is about 15 to about 80 percent and the abrasive material from 0 to about 30 percent, all by weight on a dry basis. Preferably, the filler material is about 30 to about 70 percent, the bonding agent about 25 to about 60 percent, and the abrasive material about 3 to about 15 percent. Most preferably, the filler material will be about 45 to about 65 percent, the bonding agent about 30 to about 50 percent, and the abrasive material about 4 to about 10 percent. Depending upon the specific components selected and the method of to be used to form the stones, it may be also be desirable to include a small amount of water or other liquid to create a plastic mixture which can then be readily formed. If the bonding agent is a silicate (which is conventionally available as a water solution) or any of the components contain water or other liquid, then the amount of added water or other liquid should be adjusted accordingly. Thus the total water or other liquid may be present in any amount of up to about 35 weight percent of the mixture which is formed into the stones.

After mixing the ingredients, they are subjected to an appropriate forming operation to produce stones having a generally spherical shape with a diameter of about 1 to 2 inches, preferably about 1.25 inches. Other shapes such as cylinders of similar size may also be used. A particularly suitable method of forming the stones is to extrude the stone-forming composition into the desired shape and size. To form an extrudable mixture, generally a total of about 15 to about 35 weight percent of the mixture will be water. Alternative methods which may be used include such as casting, pelletizing, and pressing. If casting is used, then the amount of water will generally be increased. In other alternative methods, the amount of water will generally be substantially lower than in an extrudable mixture and may even be omitted in its entirety if the mixture is to be, for example, dry pressed.

If the stone-forming composition includes any water or other liquid, then the crude stones are normally next dried to remove it. This drying may be performed at room temperature, if desired, but is generally performed at elevated temperatures, i.e. up to about 300 C. for a short period.

At this point in their preparation, the crude stones are water-soluble. To render them water-insoluble, they may be subjected to a calcination at a temperature greater than about 300 C. for a sufficient period of time. Preferably, the calcination is conducted at about 300 to about 1500 C. for about 5 to about 15 hours. If any of the ingredients utilized to prepare the stones are organic, then the calcination step is required to burn out the organic ingredients so that the stones will have the necessary low density and no organics will leach out during use.

If all of the ingredients are inorganic and a silicate has been used as the bonding agent, then the calcination step may be replaced by having added a conventional chemical curing agent for inorganic materials into the stone-forming mixture before the forming step. In such a case, the chemical curing agents may be used in amounts of about 1 to about 10 weight percent of the dry weight of the stone forming ingredients. Examples of suitable chemical curing agents for inorganic materials include lime, portland cement, formamide, calcium chloride, sodium aluminate, zinc oxide, magnesium oxide, and casein. In this case, only a drying operation need be performed after the stones have been formed.

The stones produced herein have a packing density less than about 50 pounds per cubic foot. Preferably the packing density is less than about 42 and most preferably it is about 40 or less pounds per cubic foot. The stones not only have relatively low packing densities, they also possess substantial porosity. Generally the stones will have a water porosity of at least about 10, preferably at least about 15, and most preferably at least about 20 percent by weight. This porosity enables the finishing stones to be used not only for stone washing of denim but also for chemical treating, i.e. bleaching, of such fabrics.

In addition, the stones are substantially stronger than conventional pumice. In an abrasion loss test, the stones lose less than about 15 percent of their weight when about 2.5 pounds of them are placed in a 8.5 inch diameter by 7.25 inch long cylinder having a ribbed rubber lining and the cylinder is tumbled at 60 rpm for 1 hour. Preferably the stones lose less than about 10 percent of their weight in the test and most preferably less than about 8 percent. The increased strength is also demonstrated by the fact that these stones generally have crush strengths of at least about 75 pounds on a flat plate crush test, preferably at least about 100 pounds. Pumice, on the other hand, loses about 40 percent of its weight in the same abrasion test and is so friable that it can be crushed by hand.

The following specific examples are provided by way of information and not limitation. They demonstrate the preparation and testing of finishing stones of this invention. All parts and percents are by weight unless otherwise specified.

EXAMPLE I

The following materials are intimately blended: 100 pounds perlite (agricultural grade, +30 U.S. mesh), 80 pounds clay (−20 U.S. mesh), 20 pounds sand (40 grit, about 500 micron), and 30 pounds of water. After a uniform plastic mixture is obtained, it is extruded through a die to form crude stones which are about 1.5 inches in diameter. The stones are oven dried at 175 C. for 2 hours and then calcined at 950 C. for 10 hours at which point the stones have become water-insoluble.

The stones are evaluated for use as finishing stones for denim fabrics by determining their packing density, abrasion loss characteristics, and water absorption. The abrasion loss is determined by placing about 2.5 pounds of the stones into a 8.5 inch diameter by 7.25 inch long cylinder having a ribbed rubber lining, and tumbling the cylinder at 60 rpm for 1 hour, and determining the weight of the fines produced. The stones of this example have a packing density of 50 pounds per cubic foot, 5% abrasion loss, and a water porosity of 23%.

The stones are then used to soften denim by placing about 30 pounds of them into a commercial washer along with 16 units of denim clothing. The washer is operated for about 80 minutes and then the denim articles are examined. They are found to have been softened to a similar extent as when pumice stones are used, but with no substantial degradation of the stones during the cycle.

EXAMPLE II

The procedure of Example I is repeated except that the formulation used to prepare the stones is changed to:

30 # walnut shells (50 U.S. mesh)
120 # clay (−325 U.S. mesh)
15 # sand (40 grit)
2 gallons water The crude stones are produced by extrusion through a die opening of about 1.25 inches. The stones are dried overnight at 100 C. and then calcined at 950 C. for ten hours. The physical properties of the stones are:

Packing density—45 pounds per cubic foot
Water porosity—23 percent
Abrasion loss—6 percent

EXAMPLE III

The procedure of Example I is repeated except that the ingredients used to form the stones are changed to:

92 # perlite (+30 U.S. mesh)
45 # sodium silicate (40% solids)
35 # clay (−325 U.S. mesh)
10 # sand (100 U.S. mesh)
25 # water The crude stones are produced as in Example II and then calcined at 500 C. for ten hours. The physical properties of these stones are:

Packing density—40 pounds per cubic foot
Water porosity—20 percent
Abrasion loss—8 percent These finishing stones have a water soaked packing density of about 60 pounds per cubic foot which is the identical water soaked packing density as pumice (which has a packing density of about 25 pounds per cubic foot and a water porosity of about 60 weight percent). Thus these stones are directly substitutable for conventional pumice without even having to vary the amount of denim included in the stone washing cycle.

EXAMPLE IV

The procedure of Example I is repeated except that 30 pounds of minus 8 mesh corncobs are added to the mixture before forming the crude stones and the water content is increased to 25 pounds. The resultant stones are calcined at 950 C. to burn out all of the corncobs. The packing density to the resultant stones is 36 pounds per cubic foot and the water porosity is 35 percent. The abrasion loss is 12 percent. The resultant stones soften denim to a similar extent as pumice in the same length washing cycle.

EXAMPLE V

The procedure of Example I is repeated except that the following ingredients are used to form the stones:

Vermiculite 40 # (#2 grade, expanded)
Clay 160 # (−60 U.S. mesh)
Sand 12 # (+100 U.S. mesh)
Water 56 #

The crude stones are produced as in Example I with calcining at 925 C. for eight hours. The water-insoluble stones have a packing density of 49 pounds per cubic foot and a water porosity of 27 percent. The abrasion loss is less than 10 percent.

EXAMPLE VI

The procedure of Example I is repeated except that the composition comprises 140 pounds perlite, 190 pounds sodium silicate (40% solids), and 30 pounds sand. The stones are formed by casting spherical shapes with approximate diameters of 1.5 inches. They are then calcined at 500 C. for then hours. The resultant stones exhibit similar properties to the stones of Example I.

EXAMPLE VII

The procedure of Example I is repeated except that the ingredients are:

Perlite 80 # (1000 microns)
Corn Starch 20 #
Sand 20 # (250 microns)
Sodium silicate 80 # (40% solids)

The resultant stones are calcined at 500 C. and have physical properties similar to those of Example I.

What is claimed is:

1. A manufactured abrasive, water-insoluble fabric finishing stone which is prepared from a combination of particulates comprised of at least one filler material, at least one bonding agent, and optionally at least one abrasive material; wherein at least either the filler material or the bonding agent is inorganic, the finishing stone has a packing density of less than about 50 pounds per cubic foot, and loses less than about 15 percent of its weight in an abrasion test wherein about 2.5 pounds of said stones are placed in a 8.5 inch diameter by 7.25 inch long cylinder having a ribbed rubber lining and the cylinder is tumbled at 60 rpm for 1 hour wherein the filler material is selected from the group consisting of perlite and vermiculite.

2. The finishing stone of claim 1 wherein the bonding agent is a mixture of a clay and an alkali metal, alkaline earth metal or ammonium silicate.

3. The finishing stone of claim 1 wherein the filler material is organic and the stone is subjected to calcination to make it water-insoluble.

4. The finishing stone of claim 1 wherein the stone is made water-insoluble by calcination.

5. The finishing stone of claim 1 wherein the filler material is inorganic the bonding agent comprises a silicate, and the stone is made water-insoluble by incorporating a chemical curing agent for inorganic materials into the combination in an amount of about 1 to about 10 weight percent of the dry weight of the combination.

6. A method of softening denim fabrics which comprises washing the fabrics in the presence of a manufactured abrasive, water-insoluble fabric finishing stone which is prepared from a combination of particulates comprised of at least one filler material, at least one bonding agent, and optionally at least one abrasive material; wherein at least either the filler material or the bonding agent is inorganic, the finishing stone has a packing density of less than about 50 pounds per cubic foot, and loses less than about 15 percent of its weight in an abrasion test wherein about 2.5 pounds of said stones are placed in a 8.5 inch diameter by 7.25 inch long cylinder having a ribbed rubber lining and the cylinder is tumbled at 60 rpm for 1 hour wherein the finishing stone is prepared from a combination comprising perlite, clay, a silicate, and sand.

* * * * *